US005981151A

United States Patent [19]

Leenders et al.

[11] Patent Number: 5,981,151

[45] Date of Patent: Nov. 9, 1999

[54] PHOTOTHERMOGRAPHIC MATERIAL AND A METHOD FOR PRODUCING LITHOGRAPHIC PLATES THEREWITH

[75] Inventors: Luc Leenders, Herentals; Ludo Van Rompuy, Mortsel, both of Belgium

[73] Assignee: Agfa-Gevaert, N.V., Mortsel, Belgium

[21] Appl. No.: 09/120,723

[22] Filed: Jul. 23, 1998

Related U.S. Application Data

[60] Provisional application No. 60/060,420, Sep. 30, 1997.

[30] Foreign Application Priority Data

Aug. 1, 1997 [EP] European Pat. Off. ..... 97202396

[51] Int. Cl.[6] ..... G03C 5/00

[52] U.S. Cl. ..... 430/353; 430/348; 430/302; 430/350; 430/619; 430/620; 430/204; 430/531; 430/617

[58] Field of Search ..... 430/350, 619, 430/620, 204, 531, 617, 348, 353, 302

[56] References Cited

U.S. PATENT DOCUMENTS 3,476,937 11/1969 Vrancken .

5,783,380 7/1998 Smith et al. ..... 430/619

OTHER PUBLICATIONS

Carpenter et al: Photothermographic Silver Halide Systems, Research Disclosure, vol. 170, No. 29, Jun. 1978 Havant GB, pp. 9–15, XP002060775.

*Primary Examiner*—Janet Baxter
*Assistant Examiner*—Amanda C. Waua
*Attorney, Agent, or Firm*—Breiner & Breiner

[57] ABSTRACT

According to the present invention there is provided a photothermographic material comprising on a support a photo-addressable thermally developable element containing a substantially light-insensitive organic heavy-metal salt, photosensitive silver halide in catalytic association with said substantially light-insensitive organic heavy-metal salt, a reductor for said substantially light-insensitive organic heavy-metal salt and a binder, said photothermographic material having on the same side of the support as said photo-addressable thermally developable element an outermost layer having two phases at least one of which being a dispersion phase of thermoplastic particles, characterized in that said two phases exhibit different affinities for at least one printing liquid selected from the group consisting of ink and an abhesive fluid for ink.

9 Claims, No Drawings

PHOTOTHERMOGRAPHIC MATERIAL AND A METHOD FOR PRODUCING LITHOGRAPHIC PLATES THEREWITH

The application claims the benefit of U.S. Provisional Application Ser. No. 60/060,420 filed Sep. 30, 1997.

DESCRIPTION

1. Field of the Invention

The present invention relates to a photothermographic material for making a lithographic printing plate. The present invention further relates to a method for preparing a printing plate from said photothermographic material.

2. Background of the Invention

Lithographic printing is the process of printing from specially prepared surfaces, some areas of which are capable of accepting ink (oleophilic areas) whereas other areas will not accept ink (oleophobic areas). The oleophilic areas form the printing areas while the oleophobic areas form the background areas.

Two basic types of lithographic printing plates are known. According to a first type, so called wet printing plates, both water, or an aqueous dampening liquid, and ink are applied to the plate surface that contains hydrophilic and hydrophobic areas. The hydrophilic areas will be soaked with water or the dampening liquid and are thereby rendered oleophobic while the hydrophobic areas will accept the ink. A second type of lithographic printing plates operates without the use of a dampening liquid and are called driographic printing plates. This type of printing plates comprise highly ink repellant areas and oleophilic areas. Generally the highly ink repellant areas are formed by a silicon layer.

Printing plates can be prepared using a photographic material that is made image-wise receptive or repellant to ink upon photo-exposure of the photographic material. However heat mode recording materials, the surface of which can be made image-wise receptive or repellant to ink upon image-wise exposure to heating by a light source and, if necessary subsequent development, are also known for preparing printing plates.

U.S. Pat. No. 3,168,864 describes a method of producing an imaged lithographic master having visibly distinguishable ink receptive areas corresponding to image areas of a differentially radiation-absorptive graphic original, the steps comprising: subjecting said original to brief intense radiation through a thin radiation-transmissive heat-sensitive copy-sheet in heat-conductive contact therewith to provide in said copy-sheet a visible, strongly radiation-absorptive reproduction of said image areas, and subjecting the thus treated copy-sheet to further brief intense irradiation in heat-conductive contact with a visibly heat-sensitive lithographic plate having a hydrophilic surface which becomes hydrophobic and ink-receptive on heating, said plate including a visibly heat-sensitive coating which is chemically reactive to form a visibly distinct reaction product when heated. A particular disadvantage of said plates is their low sensitivity and their susceptibility to register problems.

U.S. Pat. No. 3,649,271 discloses a recording material, containing in addition to a continuous phase of a hydrophilic binder and a dispersion phase of thermoplastic hydrophobic particles, a light-sensitive silver halide and a developing agent for such halide present in the outermost layer and/or in an adjacent underlying layer so that exposure and photographic development by means of an alkaline solution produces a silver image in heat-conductive relationship with the thermoplastic particles and subsequent uniform exposure by the developed silver image, the heat generated in the silver image by such absorption rendering the areas of the outermost layer in heat-conductive relationship therewith less hydrophilic. A particular disadvantage of said plates is their need for wet processing and thus generation of toxic waste.

U.S. Pat. No. 3,476,937 discloses in a method for recording or reproducing information, the improvement which comprises subjecting a recording material comprising a generally uniform layer of finely-divided particles in substantially discrete, contiguous relationship, which particles consist essentially of a hydrophobic thermoplastic material, to heat applied to said particle layer in a pattern according to said information, said heat being in a quantity sufficiently to at least partially coalesce the particles in the area of the layer corresponding to said pattern and thereby significantly reduce the fluid permeability of said layer in said at least partially coalesced area, and treating said layer to develop or reproduce said information by removing said particles in the area of said layer of substantially unreduced permeability, leaving the partially coalesced area corresponding to said heat pattern. Said patent does not disclose the presence of a substantially light-insensitive organic heavy-metal salt.

So, there is still a need for a recording element for making a lithographic plate which has a high sensitivity and has only dry processing steps and yields no waste.

SUMMARY OF THE INVENTION

It is an object of the present invention to provide a recording material for making a lithographic printing plate having a high sensitivity.

It is another object of the present invention to provide a recording material for making in a convenient way a lithographic printing plate by dry processing without creating waste, having a high sensitivity.

It is still another object of the present invention to provide a method for obtaining in a convenient way a lithographic printing plate of a high quality using said imaging material.

Further objects of the present invention will become clear from the description hereinafter.

According to the present invention there is provided a photothermographic material comprising on a support a photo-addressable thermally developable element containing a substantially light-insensitive organic heavy-metal salt, photosensitive silver halide in catalytic association with the substantially light-insensitive organic heavy-metal salt, a reductor for the substantially light-insensitive organic heavy-metal salt and a binder, the photothermographic material having on the same side of the support as the photo-addressable thermally developable element an outermost layer having two phases at least one of which being a dispersed phase of thermoplastic particles, characterized in that the two phases exhibit different affinities for at least one printing liquid selected from the group consisting of ink and an abhesive fluid for ink.

According to the present invention there is also provided a method for obtaining a lithographic printing plate comprising the steps of:

(a) image-wise or information-wise exposing to actinic light a recording material as described above (b) developing the substantially light insensitive organic heavy-metal salt by exposing the recording material to a temperature of at least 65° C. and at most 5° C. below the Tg of the thermoplastic particles, hereby forming a heavy-metal image; and (c) overall exposing said outermost layer with a light source emitting light with wavelengths being absorbed by the heavy-metal image so that the temperature of the outermost layer is imagewise increased to a temperature above the Tg of the thermoplastic particles.

DETAILED DESCRIPTION OF THE INVENTION

It has been found that the above described recording materials have a high sensitivity and yield printing plates without a wet developing process or without waste, which results in both an economical and an ecological benefit.

In the present invention a hydrophilic polymer means that water will adhere to said polymer when coated on a support and brought in contact with a mixture of water and oil. However, in the absence of water, oil can adhere to a layer of such a hydrophilic polymer. For the purposes of the present invention an oleophilic polymer is a polymer on a support to which oil will adhere when brought into contact with a mixture of water and oil.

In a first group of embodiments of the present invention the outermost layer contains an ink accepting phase and an ink and water repellant phase.

In a first embodiment of this first group of embodiments the ink accepting phase has a hydrophilic binder as the continuous phase, preferably a hardened hydrophilic continuous binder. Suitable hydrophilic binders for use in said embodiment in connection with this invention are water soluble polymers or copolymers, which may be synthetic, for example polyvinylalcohol, polymers and copolymers of (meth)acrylic acid, polymers and copolymers of (meth) acrylamide, polymers and copolymers of hydroxyethyl (meth)acrylate, polymers and copolymers of vinylmethylether etc. or natural, for example gelatin, a polysaccharide such as e.g. dextran, pullulan, cellulose, arabic gum, alginic acid.

A mixture of hydrophilic binders of the same or different types may also be used. A particularly suitable crosslinked hydrophilic layer may be obtained from a hydrophilic binder crosslinked with a crosslinking agent such as formaldehyde, glyoxal, polyisocyanate or a hydrolysed tetraalkylorthosilicate.

The ink and water repellant phase, used in the first embodiment of the first group of embodiments, contains ink and water repellant thermoplastic particles, preferably a silicon based polymer or a polymer containing perfluoroalkyl groups. Mixtures may also be used. The ratio by weight of ink and water repellant thermoplastic particles to hydrophilic binder in the range of 1:5 to 5:1, more preferably in the range of 1:2 to 2:1.

In a second embodiment of the first group of embodiments the ink accepting phase comprises a latex of an oleophilic polymer. Preferred examples of oleophilic polymers for use in connection with the present embodiment of the invention are copolymers or polymers of vinyl chloride, vinylidene chloride, acrylonitrile, vinyl carbazole etc., or mixtures thereof. Particularly preferred are copolymers and polymers of styrene or methylmethacrylate. Said polymer latex may be hardened. A mixture of latices may also be used.

The ink and water repellant phase used in the second embodiment of the first group of embodiments also contains ink and water repellant thermoplastic particles, preferably a silicon based polymer or a polymer containing perfluoroalkyl groups. A mixture thereof may also be used. The ratio by weight of ink and water repellant thermoplastic particles to oleophilic polymer is in the range of 1:10 to 10:1, more preferably in the range of 1:5 to 5:1 and particularly preferably in the range of 1:2 to 2:1.

These two embodiments have the advantage that they can be coated from an aqueous dispersion. In a third embodiment of the first group of embodiments the ink accepting phase comprises an oleophilic binder as the continuous phase. Specific examples of oleophilic polymers for use in said binder in connection with the present embodiment of the invention are oleophilic polymers as mentioned above. The oleophilic binder may be hardened and a mixture of oleophilic polymers may also be used.

The oleophilic binder can also be a water insoluble, alkali soluble or swellable resin having phenolic hydroxy groups and/or carboxyl groups. Preferred water insoluble, alkali soluble or swellable resin used in connection with the present embodiment of the invention contain phenolic hydroxy groups. Suitable water insoluble, alkali soluble or swellable resins for use in an image-forming layer in connection with this invention are for example synthetic novolac resins such as ALNOVOL, a registered trade mark of Reichold Hoechst and DUREZ, a registered trade mark of Oxychem and synthetic polyvinylphenols such as MARUKA LYNCUR M, a registered trade mark of Dyno Cyanamid.

The ink and water repellant phase, according to the third embodiment of the first group of embodiments also comprises ink and water repellant thermoplastic particles, preferably a silicon based polymer or a polymer containing perfluoroalkyl groups. A mixture of said particles may also be used. The ratio by weight of ink and water repellant thermoplastic particles to oleophilic binder is in the range of 1:10 to 10:1, more preferably in the range of 1:5 to 5:1 and particularly preferably in the range of 1:2 to 2:1. In this embodiment the coating of the recording layer is applied from an organic solvent for the oleophilic polymer.

The thermoplastic particles used in connection with this embodiment of the present invention have a coagulation temperature above 70° C. Coagulation may result from softening or melting of the thermoplastic particles under the influence of heat. There is no specific upper limit to the coagulation temperature of the thermoplastic particles, however the temperature should be sufficiently below the decomposition temperature of the thermoplastic polymer particles to avoid decomposition. Coagulation temperatures are preferred which are at least 10° C. below the temperature at which the decomposition of the thermoplastic particles occurs. When such thermoplastic particles are subjected to a temperature above the coagulation temperature they coagulate to form an ink and water repellant agglomerate.

Suitable ink accepting or ink and water repellant polymers have weight average molecular weights in the range of 5,000 to 1,000,000 Daltons.

In a second group of embodiments of the present invention the outermost layer contains an oleophilic phase and a hydrophilic phase, the oleophilic thermoplastic particles being dispersed in a continuous phase comprising a hydrophilic binder.

The hydrophilic binder used in connection with the present invention is preferably not crosslinked or only slightly crosslinked. Suitable hydrophilic binders for use in the second group of embodiments used according to the present invention are water soluble polymers or copolymers, which may be synthetic, for example polyvinylalcohol, polymers and copolymers of (meth)acrylic acid, polymers and copolymers of (meth)acrylamide, polymers and copolymers of hydroxyethyl(meth)acrylate, polymers and copolymers of vinylmethylether etc. or natural, for example gelatin, a polysaccharide such as e.g. dextran, pullulan, cellulose, arabic gum, alginic acid.

A mixture of hydrophilic binders of the same or different types may also be used.

The hydrophobic thermoplastic particles used in connection with the second group of embodiments used according to the present invention have a coagulation temperature of at least 70° C., preferably above 85° C. Coagulation may result from softening or melting of the thermoplastic particles under the influence of heat. There is no specific upper limit to the coagulation temperature of the thermoplastic particles, however the temperature should be sufficiently below the decomposition temperature of the thermoplastic polymer particles to avoid decomposition. Coagulation temperatures are preferred which are at least 10° C. below the temperature at which the decomposition of the thermoplastic particles occurs. When such thermoplastic particles are subjected to a temperature above the coagulation temperature they coagulate to form a hydrophobic agglomerate so that these parts of the hydrophobic thermoplastic particles become insoluble in water or an aqueous liquid.

Preferred oleophilic thermoplastic polymer particles for use in connection with the second group of embodiments used according to the present invention having a Tg above 85° C. contain copolymers or polymers of vinyl chloride, vinylidene chloride, acrylonitrile, vinyl carbazole etc., or mixtures thereof. Particularly preferred are copolymers and polymers of styrene or methylmethacrylate. Also a mixture of latices may be used.

Suitable hydrophobic oleophilic thermoplastic polymers have weight average molecular weights in the range of 5,000 to 1,000,000 Daltons.

The hydrophobic oleophilic thermoplastic polymer particles may have a particle size from 0.01 μm to 50 μm, more preferably between 0.05 μm and 10 μm and most preferably between 0.05 μm and 2 μm.

The hydrophobic oleophilic thermoplastic polymer particles are present as a dispersion in the aqueous coating liquid of the image forming layer and may be prepared by the methods disclosed in U.S. Pat. No. 3,476,937. Another method especially suitable for preparing an aqueous dispersion of the thermoplastic polymer particles comprises:

dissolving the hydrophobic thermoplastic polymer in an organic water immiscible solvent, dispersing the thus obtained solution in water or in an aqueous medium and removing the organic solvent by evaporation.

The amount of hydrophobic oleophilic thermoplastic polymer particles contained in the image forming layer when said layer contains a hydrophilic binder is preferably between 20% by weight and 90% by weight and more preferably between 25% by weight and 85% by weight and most preferably between 30% by weight and 80% by weight.

If the outermost layer contains a hydrophilic binder it may also comprise crosslinking agents although this is not necessary. Preferred crosslinking agents are low molecular weight substances comprising a methylol group such as for example melamine-formaldehyde resins, glycoluril-formaldehyde resins, thiourea-formaldehyde resins, guanamine-formaldehyde resins, benzoguanamine-formaldehyde resins. A number of said melamine-formaldehyde resins and glycoluril-formaldehyde resins are commercially available under the trade names of CYMEL (Dyno Cyanamid Co., Ltd.) and NIKALAC (Sanwa Chemical Co., Ltd.)

The thickness of the outermost layer ranges is preferably in the range of 0.2 to 25 μm, more preferably in the range of 1 to 10 μm.

The thermoplastic particles, whether ink and water repellant thermoplastic particles or oleophilic thermoplastic particles, can contain a plasticizer, or a plasticizer can diffuse into the thermoplastic particles during the first development step. The Tg of the thermoplastic particles referred to above is the Tg of the thermoplastic particles at the moment they are exposed overall.

The photo-addressable thermally developable element, according to the present invention, contains a substantially light-insensitive organic heavy-metal salt, photosensitive silver halide in catalytic association therewith and an organic reducing agent in thermal working relationship with the substantially light-insensitive organic heavy-metal salt and a binder. The element may comprise a layer system with the silver halide in catalytic association with the substantially light-insensitive organic silver salt ingredients, spectral sensitizer optionally together with a supersensitizer in sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive organic heavy-metal salt i.e. during the thermal development process the reducing agent and the toning agent, if present, are able to diffuse to the substantially light-insensitive organic heavy-metal salt.

The outermost layer comprising the two phases can be the outermost layer of the photo-adressable thermally developable element, but is preferably a layer overlying the photo-adressable thermally developable element.

Substantially light-insensitive organic heavy-metal salts according to the present invention can be for example iron and gold salts but are preferably silver salts, more preferably silver salts of organic carboxylic acids in particular aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)-sulfosuccinate described in EP-A 227 141. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

The photosensitive silver halide used in the present invention may be employed in a range of 0.1 to 90 mol percent; preferably, from 0.2 to 50 mol percent; particularly preferably from 0.5 to 35 mol percent; and especially from 1 to 12 mol percent of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

A suspension of particles containing a substantially light-insensitive silver salt of an organic carboxylic acid may be obtained by using a process, comprising simultaneous metered addition of an aqueous solution or suspension of an organic carboxylic acid or its salt and an aqueous solution of a silver salt to an aqueous liquid, as described in EP-A 754 969.

The silver halide may be added to the photo-addressable thermally developable element in any fashion which places it in catalytic proximity to the substantially light-insensitive organic silver salt. Silver halide and the substantially light-insensitive organic silver salt which are separately formed, i.e. ex-situ or "preformed", in a binder can be mixed prior to use to prepare a coating solution, but it is also effective to blend both of them for a long period of time. Furthermore, it is effective to use a process which comprises adding a halogen-containing compound to the organic silver salt to partially convert the substantially light-insensitive organic silver salt to silver halide as disclosed in U.S. Pat. No. 3,457,075.

A particularly preferred mode of preparing the emulsion of organic silver salt and photosensitive silver halide for coating of the photo-addressable thermally developable element from solvent media, according to the present invention is that disclosed in U.S. Pat. No. 3,839,049, but other methods such as those described in Research Disclosure, June 1978, item 17029 and U.S. Pat. No. 3,700,458 may also be used for producing the emulsion.

A particularly preferred mode of preparing the emulsion of organic silver salt and photosensitive silver halide for coating of the photo-addressable thermally developable element from aqueous media, according to the present invention is that disclosed in the unpublished PCT-application PCT/EP96/02579, which discloses a production method for a photothermographic material comprising the steps of: (i) providing a support; (ii) coating the support with a photo-addressable thermally developable element comprising a substantially light-insensitive organic silver salt, photosensitive silver halide in catalytic association with the substantially light-insensitive organic silver salt, a reducing agent in thermal working relationship with the substantially light-insensitive organic silver salt and a binder, characterized in that the photosensitive silver halide is formed by reacting an aqueous emulsion of particles of the substantially light-insensitive organic silver salt with at least one onium salt with halide or polyhalide anion(s) and that the photo-addressable thermally developable element is coated from an aqueous dispersion medium.

Suitable organic reducing agents for the reduction of the substantially light-insensitive organic heavy-metal salts are organic compounds containing at least one active hydrogen atom linked to O, N or C, such as is the case with, mono-, bis-, tris- or tetrakis-phenols; mono- or bis-naphthols; di- or polyhydroxy-naphthalenes; di- or polyhydroxybenzenes; hydroxymonoethers such as alkoxynaphthols, e.g. 4-methoxy-1-naphthol described in U.S. Pat. No. 3,094,417; pyrazolidin-3-one type reducing agents, e.g. PHENIDONE™; pyrazolin-5-ones; indan-1,3-dione derivatives; hydroxytetrone acids; hydroxytetronimides; 3-pyrazolines; pyrazolones; reducing saccharides; aminophenols e.g. METOL™; p-phenylenediamines, hydroxylamine derivatives such as for example described in U.S. Pat. No. 4,082,901; reductones e.g. ascorbic acids; hydroxamic acids; hydrazine derivatives; amidoximes; n-hydroxyureas; and the like, see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol and substituted catechols are preferred.

Among substituted catechol, i.e. reducing agents containing at least one benzene nucleus with two hydroxy groups (—OH) in ortho-position, are preferred 1,2-dihydroxybenzoic acid, 3-(3',4'-dihydroxyphenyl)propionic acid, pyrogallol, polyhydroxy spiro-bis-indane compounds, gallic acid, gallic acid esters e.g. methyl gallate, ethyl gallate and propyl gallate, tannic acid and 3,4-dihydroxy-benzoic acid esters are preferred. Particularly preferred catechol-type reducing agents are described in EP-A 692 733 and EP-A 599 369.

Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermally developable elements on the basis of photosensitive silver halide/organic silver salt/reducing agent.

During the thermal development process the reducing agent must be present in such a way that it is able to diffuse to the substantially light-insensitive organic heavy-metal salt particles so that reduction of the organic heavy-metal salt can take place.

The heavy-metal image density depends on the coverage of the above defined reducing agent(s) and organic heavy-metal salt(s) and has preferably to be such that, on heating above 80° C., an optical density of at least 1.5 can be obtained. Preferably at least 0.10 moles of reducing agent per mole of organic heavy-metal salt is used.

The above mentioned reducing agents being considered as primary or main reducing agents may be used in conjunction with so-called auxiliary reducing agents. Auxiliary reducing agents that may be used in conjunction with the above-mentioned primary reducing agents are sulfonamidophenols as described in the periodical Research Disclosure, February 1979, item 17842, in U.S. Pat. Nos. 4,360,581 and 4,782,004, and in EP-A 423 891.

Other auxiliary reducing agents which increase the gradient of the heavy-metal image that may be used in conjunction with the above mentioned primary reducing agents are hydrazines, such as disclosed in EP-A 762 196; sulfonyl hydrazide reducing agents such as disclosed in U.S. Pat. No. 5,464,738; alkenyl hydrazines as disclosed in EP-A 741 320; trityl hydrazides and formyl-phenyl-hydrazides as disclosed in U.S. Pat. No. 5,496,695; trityl and formyl-phenyl-hydrazines in combination with amines, hydroxamine acid, N-acyl-hydrazines and hydrogen atom donors, such as disclosed in U.S. Pat. No. 5,545,505, U.S. Pat. No. 5,637,449, U.S. Pat. No. 5,545,507 and U.S. Pat. No. 5,558,983; hydroxamic acids, such as disclosed in EP-A 764.878; acrylonitriles such as disclosed U.S. Pat. No. 5,545,515 and U.S. Pat. No. 5,635,339; and organic reducing metal salts, e.g. stannous stearate described in U.S. Pat. Nos. 3,460,946 and 3,547,648. A high gradient is required for a printing plate.

The photo-addressable thermally developable element of the photothermographic material, according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Suitable supersensitizers for use with red spectral sensitizers are disclosed in EP-A's 559 228 and 587 338 and in the U.S. Pat. Nos. 3,877,943 and 4,873,184.

The film-forming binder for the photo-addressable thermally developable element used according to the present invention may be coatable from a solvent or aqueous dispersion medium.

The film-forming binder for the photo-addressable thermally developable element used according to the present invention may be coatable from a solvent dispersion medium, according to the present invention, may be all kinds of natural, modified natural or synthetic resins or mixtures of such resins, wherein the organic heavy-metal salt can be dispersed homogeneously: e.g. polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof. A particularly suitable polyvinyl butyral containing a minor amount of vinyl alcohol units is marketed by MONSANTO USA under the trade names BUTVAR™ B76 and BUTVAR™ B79 and provides a good adhesion to paper and properly subbed polyester supports.

The film-forming binder for the photo-addressable thermally developable element coatable from an aqueous dispersion medium, used according to the present invention, may be all kinds of transparent or translucent water-dispersible or water soluble natural, modified natural or synthetic resins or mixtures of such resins, wherein the organic heavy-metal salt can be dispersed homogeneously for example proteins, such as gelatin and gelatin derivatives (e.g. phthaloyl gelatin), cellulose derivatives, such as carboxymethylcellulose, polysaccharides, such as dextran, starch ethers etc., galactomannan, polyvinyl alcohol, polyvinylpyrrolidone, acrylamide polymers, homo- or co-polymerized acrylic or methacrylic acid, latexes of water dispersible polymers, with or without hydrophilic groups, or mixtures thereof. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

The binder to organic heavy-metal salt weight ratio is preferably in the range of 0.2 to 6, and the thickness of the photo-addressable thermally developable element is preferably in the range of 1 to 50 μM.

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in solid state at temperatures below 50° C. but becomes a plasticizer in the heated region and/or liquid solvent for at least one of the redox-reactants, e.g. the reducing agent for the organic heavy-metal salt, at a temperature above 60° C.

In order to obtain a neutral black image tone the photo-addressable thermally developable element preferably contains in admixture with the organic heavy-metal salts and reducing agents a so-called toning agent known from thermography or photothermography.

Suitable toning agents are succinimide, phthalazine and the phthalimides and phthalazinones within the scope of the general formulae described in U.S. Pat. No. 4,082,901 and the toning agents described in U.S. Pat. Nos. 3,074,809, 3,446,648 and 3,844,797. Particularly useful toning agents are the heterocyclic toner compounds of the benzoxazine dione or naphthoxazine dione type as described in GB-P 1,439,478, U.S. Pat. No. 3,951,660 and U.S. Pat. No. 5,599,647.

In order to obtain improved shelf-life and reduced fogging, stabilizers and antifoggants may be incorporated into the photo-addressable thermally developable elements of the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-triazolium-3-thiolate stabilizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

In addition to the ingredients the photo-addressable thermally developable element may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Öl A (tradename of BAYER AG—GERMANY), ultraviolet light absorbing compounds, white light reflecting and/or ultraviolet radiation reflecting pigments, silica, colloidal silica, fine polymeric particles [e.g. of poly(methylmethacrylate)] and/or optical brightening agents.

The support for the photothermographic material according to the present invention may be transparent, translucent or opaque, e.g. having a white light reflecting aspect and is preferably a thin flexible carrier made of e.g. sheet metal, e.g. aluminium, paper, polyethylene coated paper or transparent resin film, e.g. made of a cellulose ester, e.g. cellulose triacetate, corona and flame treated polypropylene, polystyrene, polymethacrylic acid ester, polyimide, polycarbonate or polyester, e.g. polyethylene terephthalate or polyethylene naphthalate as disclosed in GB 1,293,676, GB 1,441,304 and GB 1,454,956. For example, a paper base substrate is present which may contain white reflecting pigments, optionally also applied in an interlayer between the photo-addressable thermally developable element and the paper base substrate. The support may also be glass.

The support may be in sheet, ribbon or web form and subbed if need be to improve the adherence to the thereon coated photo-addressable thermally developable element. The support may be made of an opacified resin composition, e.g. polyethylene terephthalate opacified by means of pigments and/or micro-voids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, the base may be substantially colourless or coloured, e.g. having a blue colour.

In order to obtain a lithographic printing plate a photothermographic material as described above is image-wise or information-wise exposed to actinic light.

Actinic light is light that is absorbed by the photo-addressable thermally developable element. UV light is in all cases actinic light. Blue light, green light and red light can be actinic light depending on the composition and the optional spectral sensitization of the silver halide.

In a following step the exposed photothermographic material is heated to a temperature of at least 60° C. and at most 5° C. below the Tg of the thermoplastic particles in order to develop the substantially light insensitive organic heavy-metal salt. Preferably said temperature ranges from 85° C. to 95° C. Said heating does not take long, preferably between 2 and 30 seconds, more preferably between 5 and 20 seconds.

In a last step the image-wise exposed and heated photothermographic material is overall exposed to a light source emitting light with a wavelenght being absorbed by the heavy-metal image.

When the image-wise exposed and heated photothermographic material is overall exposed, the image areas of the image-wise exposed and heated photothermographic material are warmed up to a temperature higher than the Tg of the thermoplastic particles and at least 10° C. below the decomposition temperature of the thermoplastic particles. In most cases a temperature between 110 and 150° C. is preferred.

Preferably the overall exposure is carried out with a light source selected from the group consisting of an IR-illuminator and an IR-laser.

It is to be noted that the photothermographic material according to the present invention can yield waterless offset printing plates as well as printing plates which need water or a fountain solution for printing. Indeed the photothermographic recording materials according to the first group of embodiments of the present invention wherein the outermost layer contains an ink accepting phase and an ink and water repellant phase yield waterless offset printing plates. The photothermographic recording materials according to the second group of embodiments of the present invention wherein the outermost layer contains an oleophilic phase and a hydrophilic phase yield printing plates which need water or a fountain solution for printing.

The following examples illustrate the present invention without limiting it thereto. All parts are by weight unless otherwise specified.

EXAMPLE 1

Preparation of the photo-addressable thermally developable layer.

On a subbed polyethylene terephthalate support was coated a layer with the following composition

| | |
|---|---|
| silver behenate | 4.00 g/m$^2$ |
| (2-triphenylphosphonium) propionic acid iodide | 0.30 g/m$^2$ |
| copolymer of methylmethacrylate, butadiene and itaconic acid | 4.00 g/m$^2$ |
| 3-(3',4'-dihydroxyphenyl) propionic acid | 0.70 g/m$^2$ |
| phthalazine | 0.20 g/m$^2$ |

Preparation of the outermost layer.

A dispersion is prepared by adding 4 g Syloid™ 161 (a $SiO_2$ matting agent with an average diameter of 4 $\mu$m from Grace) to 25.5 g of a 5.5% by weight polyvinylalcohol. To this dispersion is added 7 g of a 20% by weight of a polystyrene dispersion and 2.1 g of a 23.8% by weight of a tetramethylorthosilicate. This dispersion is diluted with deionized water to a final volume of 40 ml. The obtained dispersion is well mixed and applied on the photo-addressable thermally developable layer in red light to a final wet thickness of 30 $\mu$m.

Preparation of a printing plate

The dried plate is image-wise exposed on a metal halogen lamp CDLi 1205 contact illuminator (80 units, level 3). Development of the silver image is obtained by heating the exposed material on a hot plate of 90° C. for 10 seconds. Subsequently the plate is irradiated by an IR-lamp, to a final temperature of 120–130° C. at the surface of the printing plate.

The printing plate thus obtained was printed on an ABDick 360 printing press inked with Van Son Rubberbase and 2% Tame as fountain solution.

EXAMPLE 2

A coating solution is prepared by mixing 10 g of a 20% silver behenate dispersion and 13.33 g of a 1.24% triphenyl-phosphonium propionic acid iodide. The solution is well mixed during 15 minutes. This solution is then added under constant stirring to a dispersion which contains 2.0 g $SiO_2$ (Syloid 161 sold by Grace Gmbh, Germany) with an average diameter of 4 $\mu$m, 12.75 g of a 5.5% solution of polyvinyl alcohol and 5.8 g of a 12.45% polystyrene dispersion.

To this dispersion is added under constant stirring 1.0 g of a 24.88% solution of tetramethyl orthosilicate, 2.16 g of a 5.6% solution of phthalazinone and 6.66 g of a 5.4% of a solution of dihydroxyfenyl propionic acid. After mixing the dispersion is coated on a subbed polyethylene terephthalate support with a 100 $\mu$m coating knife. The layer is dried during 5 hours at a temperature of 40° C.

The layer is image-wise exposed with a CDL 1205 (a 1200 W metal halogen lamp; 8 s.; level 3). The image is processed at a warm surface at a temperature of 90° C. for 10 s. The imaged element is now overall exposed to an IR-emitter (Elstein FSR-250 W)during 10 s. The plate is then used as a wet offset plate on an ABDick 360 printing press with a Van Son Rubberbase ink and a 2% Tame fountain. A clear printed image was obtained.

EXAMPLE 3

A coating solution is prepared by mixing 4.06 g of a 12.45% polystyrene dispersion with 4.0 g of a 50% silicon emulsion (Dehesive 410E from Wacker) and 0.81 g of a 37% solution of a crosslinking agent (Crosslinking Agent V72 from Wacker). The dispersion is then made up with water to a volume of 10 ml. The dispersion is well mixed and coated in red light on the photo-addressable thermally developable layer as described in example 1. with a coating knife of 10 μm. The layer is then dried during 6 hours at a temperature of 60° C.

The layer is image-wise exposed with a CDL 1205 (a 1200 W metal halogen lamp; 8 s.; level 3). The image is processed at a warm surface at a temperature of 90° C. for 10 s. The imaged element is now overall scanned with a NdYLF laser (1053 nm) at a drumspeed of 2 m/s, an output level of 200 mw and a spot diameter of 16 μm.

The plate is then used as a waterless printing plate on an ABDick 9860 printing press with a Hostmann-Steinberg Reflecta dry ink (magenta).

We claim:

1. A method for obtaining a lithographic printing plate comprising the steps of:

(a) image-wise or information-wise exposing to actinic light a photothermographic material comprising on a support a photo-addressable thermally developable element containing a substantially light-insensitive organic heavy-metal salt, photosensitive silver halide in catalytic association with said substantially light-insensitive organic heavy-metal salt, a reductor for said substantially light-insensitive organic heavy-metal salt and a binder, said photothermo-graphic material having on the same side of the support as said photo-addressable thermally developable element an outermost layer having two phases at least one of which being a dispersion phase of thermoplastic particles, wherein said two phases exhibit different affinities for at least one printing liquid selected from the group consisting of ink and an abhesive fluid for ink;

(b) developing the substantially light insensitive organic heavy-metal salt by exposing the recording material to a temperature of at least 65° C. and at most 5° C. below the Tg of the thermoplastic particles, hereby forming a heavy-metal image; and (c) overall exposing said outermost layer with a light source emitting light with wavelengths being absorbed by the heavy-metal image so that the temperature of the outermost layer is imagewise increased to a temperature above the Tg of the thermoplastic particles.

2. A method for obtaining a lithographic printing plate according to claim 1 wherein said outermost layer contains an ink accepting phase and an ink and water repellant phase.

3. A method for obtaining a lithographic printing plate according to claim 2 wherein said ink accepting phase comprises a continuous hydrophilic binder.

4. A method for obtaining a lithographic printing plate according to claim 2 wherein said ink accepting phase comprises a latex of an oleophilic polymer.

5. A method for obtaining a lithographic printing plate according to claim 2 wherein said ink accepting phase comprises a continuous oleophilic binder.

6. A method for obtaining a lithographic printing plate according to claim 1 wherein said outermost layer contains an oleophilic phase and a hydrophilic phase.

7. A method for obtaining a lithographic printing plate according to claim 1 wherein said thermoplastic particles have a coagulation temperature of at least 70° C.

8. A method for obtaining a lithographic printing plate according to claim 1, 2, 3,4, 5, 6, or 7 wherein the thickness of the outermost layer ranges from 0.2 to 25 μm.

9. A method for obtaining a lithographic printing plate according to claim 1, 2, 3, 4, 5, 6 or 7 wherein said substantially light-insensitive organic heavy-metal salt is a substantially light-insensitive organic silver salt.

* * * * *